US011154147B2

(12) United States Patent
Adeeb, Jr.

(10) Patent No.: US 11,154,147 B2
(45) Date of Patent: Oct. 26, 2021

(54) SUPPORT UTILITY CUSHION FOR HEAD, NECK, AND BODY

(71) Applicant: Victor George Adeeb, Jr., Los Angeles, CA (US)

(72) Inventor: Victor George Adeeb, Jr., Los Angeles, CA (US)

( * ) Notice: Subject to any disclaimer, the term of this patent is extended or adjusted under 35 U.S.C. 154(b) by 0 days.

(21) Appl. No.: 16/368,835

(22) Filed: Mar. 28, 2019

(65) Prior Publication Data

US 2021/0068561 A1 Mar. 11, 2021

Related U.S. Application Data

(60) Provisional application No. 62/649,041, filed on Mar. 28, 2018.

(51) Int. Cl.

| | |
|---|---|
| ***A47G 9/10*** | (2006.01) |
| ***A47C 20/02*** | (2006.01) |
| ***A47C 7/38*** | (2006.01) |

(52) U.S. Cl.

CPC ..... *A47G 9/10* (2013.01); *A47C 7/383* (2013.01); *A47C 20/02* (2013.01); *A47G 2009/1018* (2013.01)

(58) Field of Classification Search

CPC ..... A47G 9/10; A47G 9/1072; A47G 9/1081; A47G 9/109; A47G 2009/1018; A47C 7/383; A47C 7/36; A47C 7/38; A47C 7/42; A47C 20/02; A47C 20/026

USPC ..... 5/645, 655.4, 644

See application file for complete search history.

(56) References Cited

U.S. PATENT DOCUMENTS

| | | | | | |
|---|---|---|---|---|---|
| 2,336,707 | A | * | 12/1943 | Thompson | A47C 7/383 5/636 |
| 2,896,227 | A | * | 7/1959 | Reed | A47C 27/10 5/644 |
| 3,204,678 | A | * | 9/1965 | Worcester | A45C 3/10 383/3 |
| 3,283,343 | A | * | 11/1966 | Worcester | A47C 27/081 5/644 |
| 3,411,164 | A | * | 11/1968 | Sumergrade | A47G 9/10 5/644 |

(Continued)

FOREIGN PATENT DOCUMENTS

| | | | | | |
|---|---|---|---|---|---|
| DE | 3331689 | A1 | * | 3/1985 | A47C 27/085 |
| DE | 102005004033 | A1 | * | 8/2006 | A47G 9/10 |
| GB | 362282 | A | * | 12/1931 | A47G 9/10 |

*Primary Examiner* — Michael Safavi

(74) *Attorney, Agent, or Firm* — Hodgson Russ LLP

(57) ABSTRACT

A pillow is described. The pillow includes an elongate outer fabric cover at least partially forming a closed elongate tube with the outer cover. The pillow also includes at least one aperture in the closed elongate tube, the at least one aperture having a selective closure associated therewith. Further, the pillow includes at least one baffle formed within the elongate tube. The at least one baffle is formed of fabric and is coupled to the outer cover at at least three points around the interior of the elongate tube. Further still, the pillow includes a filling material disposed within the elongate tube, the filing material comprises individual pieces of filling material. The filling material is configured with a size that it may bypass the baffle, but not generally freely. The elongate outer fabric and the filling material are configured to be bendable to any of a variety of shapes.

20 Claims, 14 Drawing Sheets

(56) References Cited

U.S. PATENT DOCUMENTS 3,762,404 A * 10/1973 Sakita ..... A43B 17/035 602/6
D314,116 S * 1/1991 Reed ..... D6/601
5,471,691 A * 12/1995 Ryndak ..... A47G 9/10 5/636
5,584,086 A * 12/1996 VanWinkle ..... A47C 20/021 5/490
5,661,862 A * 9/1997 Ryndak ..... A47G 9/10 5/636
D417,997 S * 12/1999 Yannakis ..... D6/601
6,052,848 A * 4/2000 Kelly ..... A47C 20/021 5/630
6,088,854 A * 7/2000 Brownrigg ..... A47C 20/021 5/632
6,131,219 A * 10/2000 Roberts ..... A47G 9/1027 5/636
D440,807 S * 4/2001 Liu ..... 5/644
6,254,189 B1 * 7/2001 Closson ..... A47C 7/383 297/397
6,671,908 B2 * 1/2004 Brown ..... A47C 7/546 5/644
6,874,183 B1 * 4/2005 Taylor ..... A47C 20/021 5/630
7,080,421 B1 * 7/2006 Delfs ..... A47G 9/0207 5/502
7,222,379 B2 * 5/2007 DiGirolamo ..... A47G 9/10 5/636
7,353,552 B2 * 4/2008 Leach ..... A47C 20/021 5/632
7,578,013 B2 * 8/2009 Aikman ..... A47C 20/021 5/632
D663,988 S * 7/2012 Bannister ..... D6/601
9,021,635 B1 * 5/2015 Leach ..... A47C 20/02 5/632
10,736,444 B1 * 8/2020 Leach ..... A61G 7/065
10,869,565 B2 * 12/2020 Ponder ..... A47G 9/1081
2006/0236459 A1 * 10/2006 Lavin ..... A47G 9/109 5/636
2007/0220678 A1 * 9/2007 Ciliento ..... A47G 9/10 5/636
2008/0250566 A1 * 10/2008 Brogan ..... A47G 9/10 5/645
2009/0025147 A1 * 1/2009 Palmer ..... A47C 27/002 5/644
2014/0115787 A1 * 5/2014 Garcia ..... A47G 9/10 5/636
2016/0037946 A1 * 2/2016 Melcher ..... A47C 20/023 5/636
2017/0099967 A1 * 4/2017 Holbrook ..... A47G 9/1081
2018/0153240 A1 * 6/2018 Brattli ..... A63H 3/02
2018/0206648 A1 * 7/2018 Virissimo ..... A47G 9/1054
2020/0154912 A1 * 5/2020 Del Balso ..... A47G 9/1027

* cited by examiner

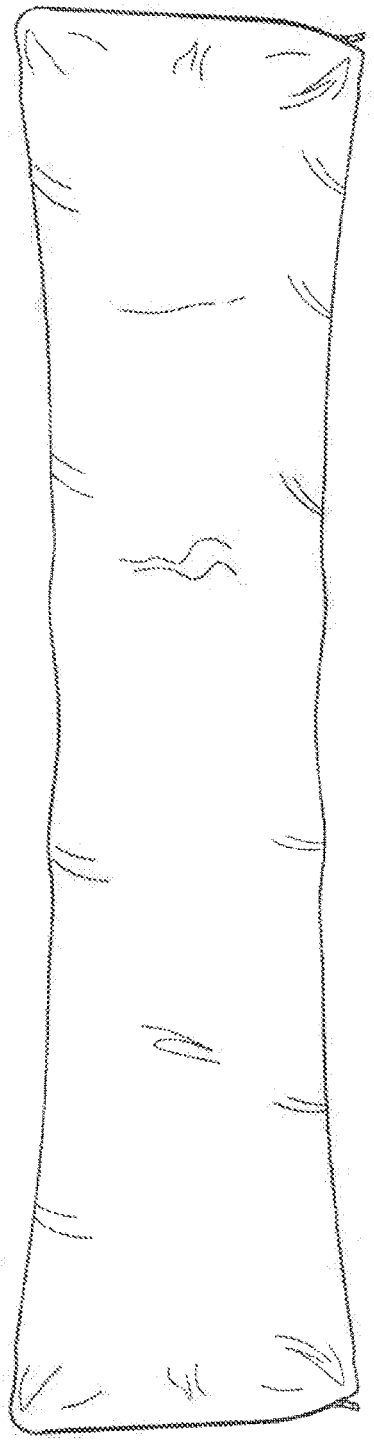
FIG. 8A(1)

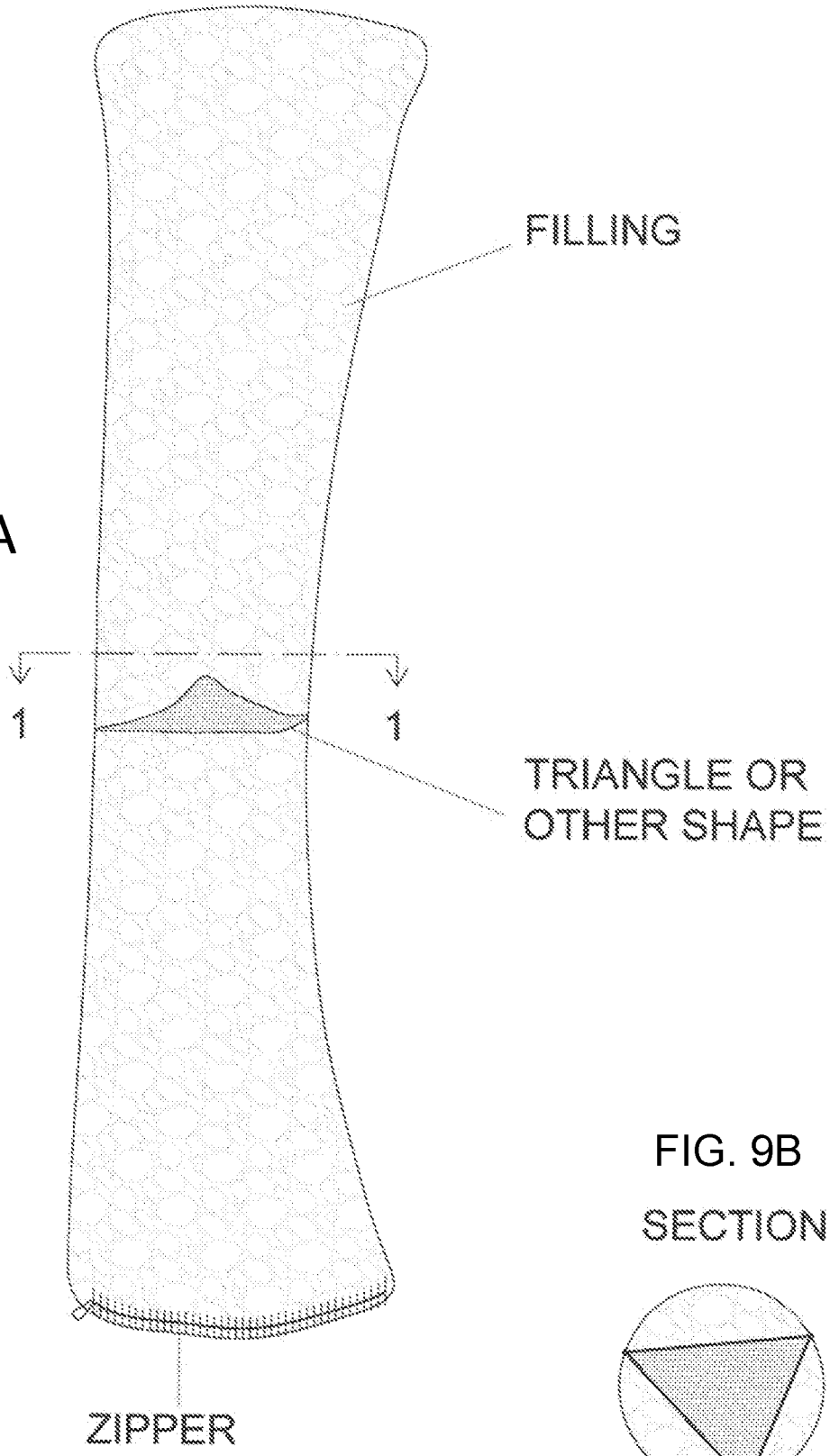
FIG. 9A
FIG. 9B
SECTION 1-1
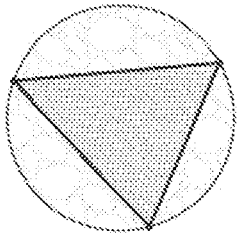

SUPPORT UTILITY CUSHION FOR HEAD, NECK, AND BODY

REFERENCE TO RELATED APPLICATIONS

This application claims priority to U.S. Provisional Application No. 62/649,041, filed on Mar. 28, 2018 to Inventor Victor George Adeeb Jr and entitled AT HOME OR AWAY THERAPEUTIC RESTING SLEEPING SITTING SUPPORT UTILITY CUSHION (PILLOW) FOR HEAD, NECK, AND BODY, which is herein incorporated by reference in its entirety.

BACKGROUND

Humans spend approximately one third of their lifetimes sleeping and resting. Accordingly, it is extremely important that their body and head are both supported and positioned in desirable ways. Many head pillows for example tend to elevate the head too much as to cause too much bending in the neck and cause the chin to come too close to the chest while sleeping. Further, many pillows are designed to position a person in a particular way and are thus fairly inflexible due to their shape and design. These pillows also tend to be large and not suitable for traveling or for use while sitting. Further still, conventional pillows are not designed to be customized to a user.

Accordingly, there is a need for a support pillow that when used as a head pillow while lying down, will not cause excess bending of the neck or misalignment of the spine. Further, there is a need for a support pillow that is therapeutic and can be used while resting, sleeping, or sitting and will provide support for the head, neck and body in a number of positions. Further still, there is a need for a support cushion that is compact enough to be mobile and utilized when traveling.

SUMMARY

An exemplary embodiment relates to a pillow. The pillow includes an elongate outer fabric cover at least partially forming a closed elongate tube with the outer cover. The pillow also includes at least one aperture in the closed elongate tube, the at least one aperture having a selective closure associated therewith. Further, the pillow includes at least one baffle formed within the elongate tube. The at least one baffle is formed of fabric and is coupled to the outer cover at at least three points around the interior of the elongate tube. Further still, the pillow includes a filling material disposed within the elongate tube, the filing material comprises individual pieces of filling material. The filling material is configured with a size that it may bypass the baffle, but not generally freely. The elongate outer fabric and the filling material are configured to be bendable to any of a variety of shapes.

Another exemplary embodiment relates to a pillow. The pillow includes an elongate outer fabric cover at least partially forming a closed elongate tube with the outer cover, the closed elongate tube is tapered near the middle of the tube such that the middle portion of the tube is substantially narrower than at each end of the elongate tube. The pillow also includes at least one aperture in the closed elongate tube. The at least one aperture has a selective closure associated therewith. The pillow further includes at least one baffle formed within the elongate tube. The at least one baffle is formed of fabric and is coupled to the outer cover at at least three points around the interior of the elongate tube. At least one of the at least one baffle is coupled to the outer cover proximate the middle of the middle portion of the elongate tube. Further still, the pillow includes filling material disposed within the elongate tube. The filing material comprises individual pieces of filling material. the filling material configured with a size that it may bypass the baffle, but not generally freely. The elongate outer fabric and the filling material are configured to be bendable to any of a variety of shapes.

Yet another exemplary embodiment relates to a pillow. The pillow includes an elongate outer elasticized fabric cover at least partially forming a closed elongate tube with the outer cover. The closed elongate tube is tapered near the middle of the tube such that the middle portion of the tube is substantially narrower than at each end of the elongate tube. The pillow also included at least one aperture in the closed elongate tube. The at least one aperture has a zippered closure configured to provide selective access to the interior of the elongate tube. At least one baffle is formed within the elongate tube. The at least one baffle is formed of fabric and being coupled to the outer cover at three points around the interior of the elongate tube. At least one of the at least one baffle is coupled to the outer cover proximate the middle of the middle portion of the elongate tube. The at least one baffle comprises a triangle shaped piece of fabric, disposed within the tube, and attached at each corner of the triangle to the outer cover. A filling material is disposed within the elongate tube. The filing material comprises individual pieces of filling material. The filling material is configured with a size that it may bypass the baffle, but not generally freely. The elongate outer fabric and the filling material are configured to be bendable to any of a variety of shapes.

In addition to the foregoing, other system aspects are described in the claims, drawings, and text forming a part of the disclosure set forth herein. The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the disclosures set forth herein.

BRIEF DESCRIPTION OF THE DRAWINGS

FIG. 8A(1) is an exemplary embodiment of a tapered pillow.

FIG. 9A is an exemplary embodiment of the interior of the middle section of an exemplary embodiment of the pillow depicting an exemplary baffle.

FIG. 9B is an exemplary cross section view of the baffle depicted in FIG. 9A.

The use of the same symbols in different drawings typically indicates similar or identical items unless context dictates otherwise.

DETAILED DESCRIPTION

Figure 1:
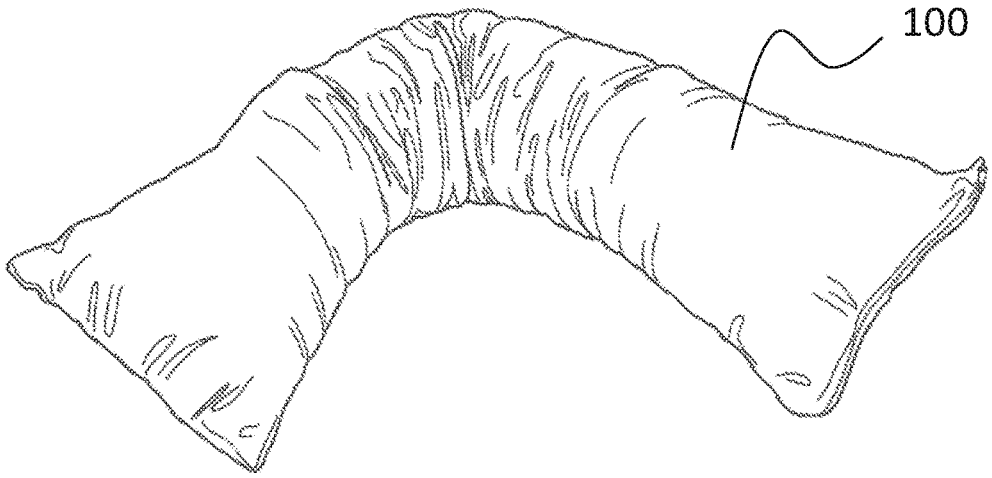
FIG. 1 an exemplary embodiment of a pillow or cushion.
Figure 2:
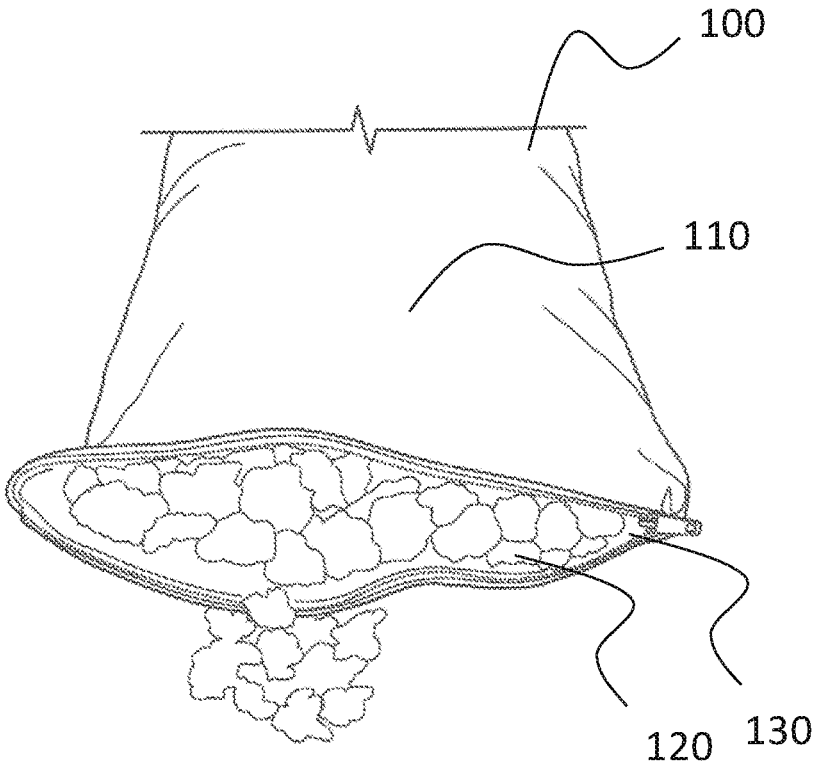
FIG. 2 is an exemplary embodiment of the pillow or cushion of FIG. 1 showing the closure and interior filling.

In accordance with one or more exemplary embodiments, a support cushion or pillow 100 as depicted in FIG. 1 is an elongated pillow which is bendable at any of a variety of shapes. Pillow 100 is designed to place the head neck and spine in alignment while resting, sleeping, sitting, or lying down. Referring now to FIG. 2, support pillow 100 includes an outer cover 110 which may be made of any of a variety of flexible fabric materials. Outer cover 110 encloses a stuffing material 120 which may be any of a variety of stuffing materials including, but not limited to memory foam, latex foam, polyester fill, natural latex foam, kapok, natural foam, down, etc. In some exemplary embodiments, a closure, such as but not limited to a zipper 130, a Velcro closure, etc. is used to access the fill material 120 so that additional fill material 120 may be added or fill material 120 may be removed in order to adjust the density and firmness of pillow 100.

Figure 3:
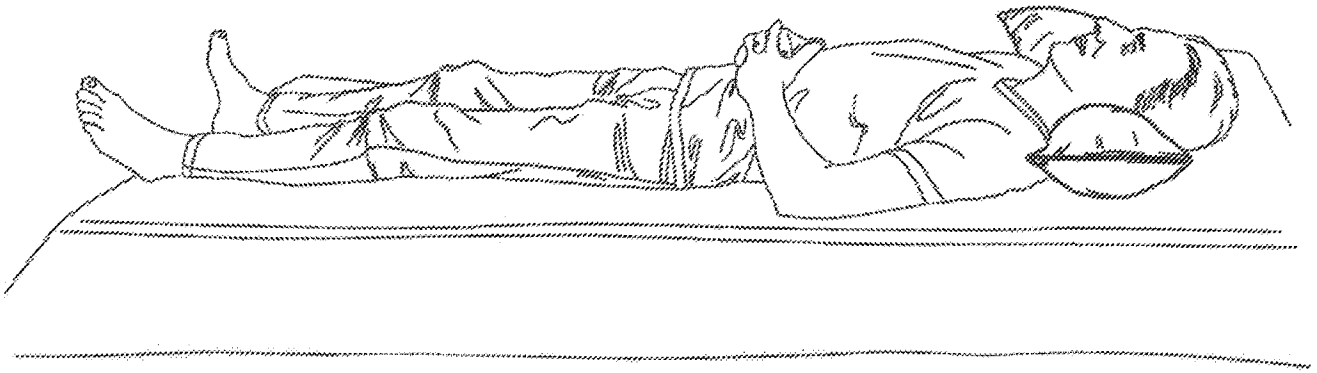
FIGS. 3-19 are exemplary embodiments of a person using the pillow in various positions.
Figure 4:
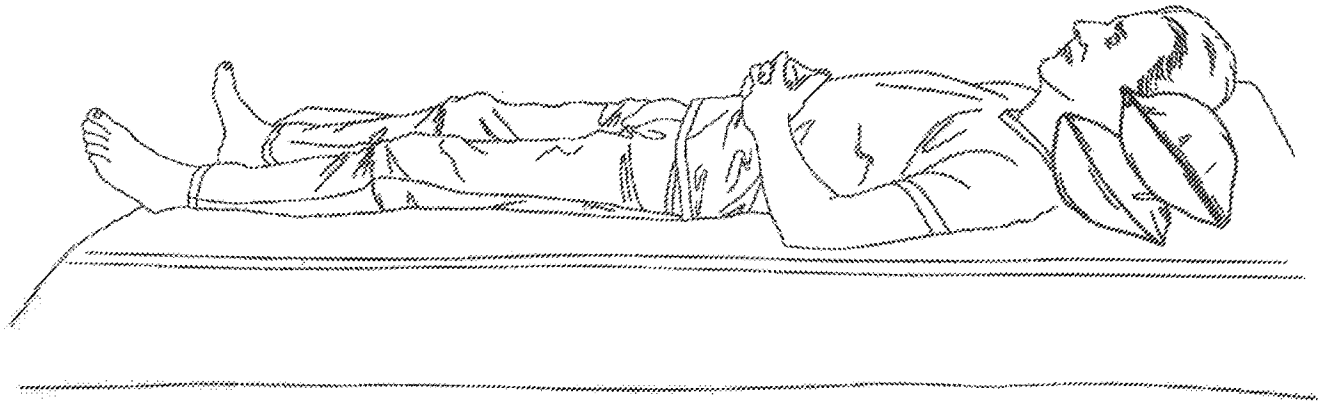
Figure 3A:
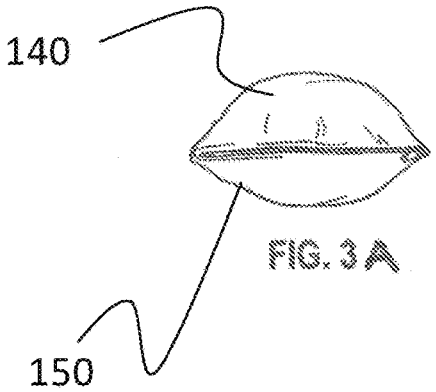
FIGS. 3A and 4A are exemplary end views of an exemplary embodiment of the pillow.
Figure 4A:
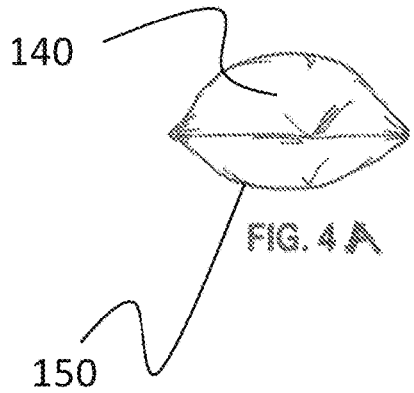
Figure 5A:
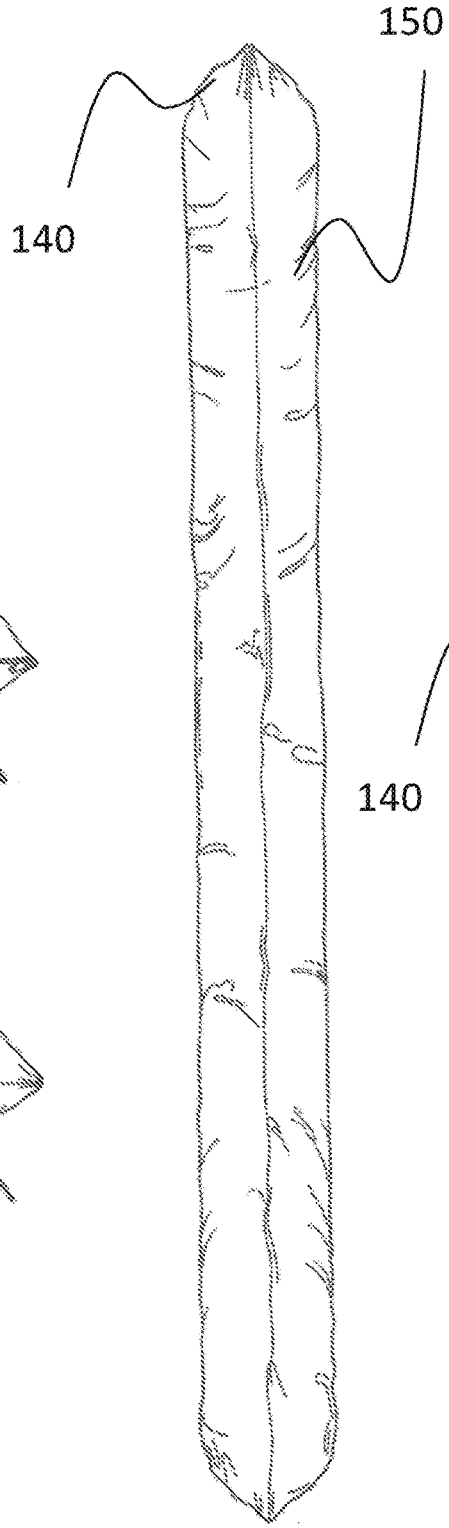
FIGS. 5A and 6A are exemplary side views of an exemplary embodiment of the pillow.
Figure 6A:
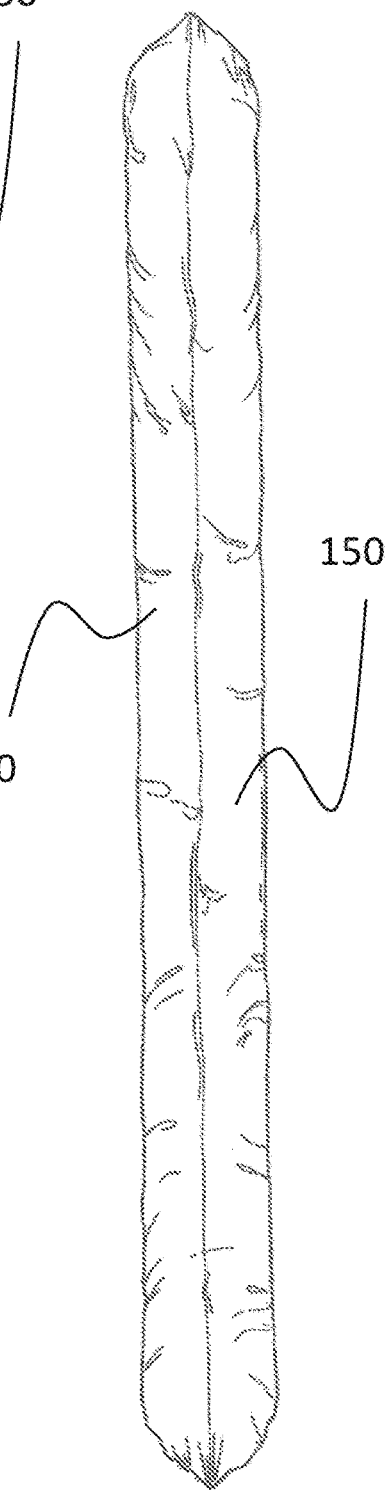
Figure 5:
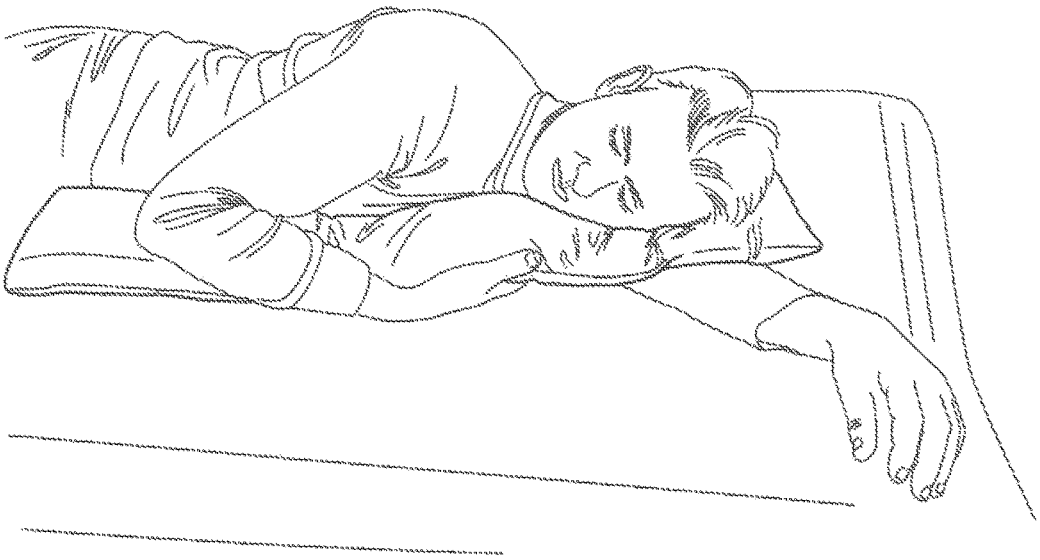
Figure 6:
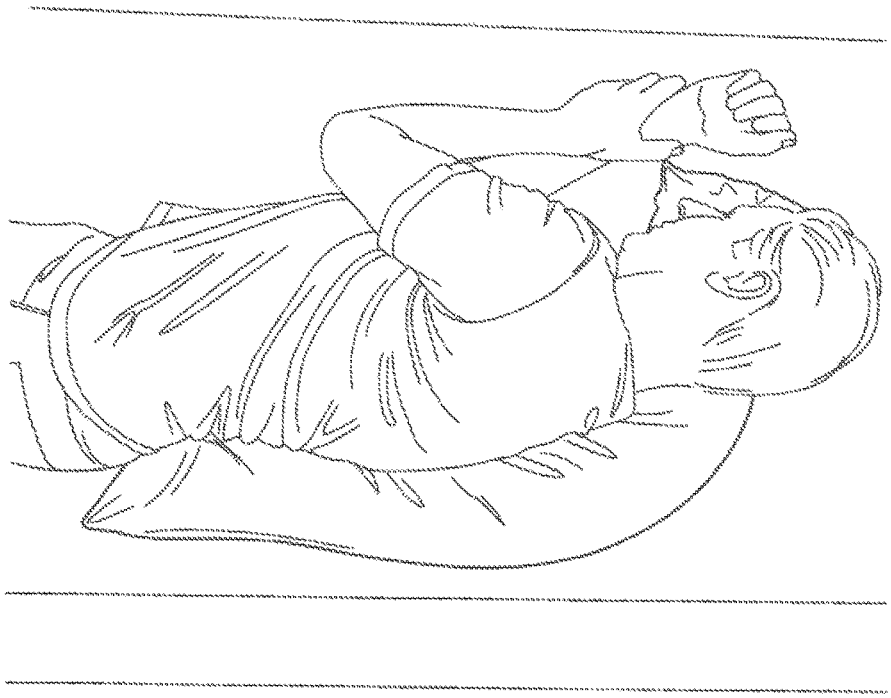
Figure 7:
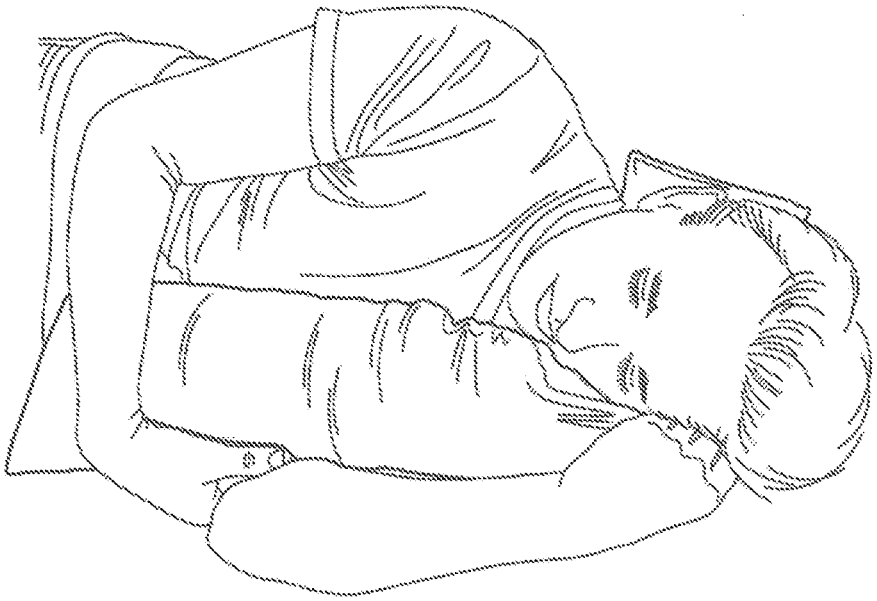
Figure 8:
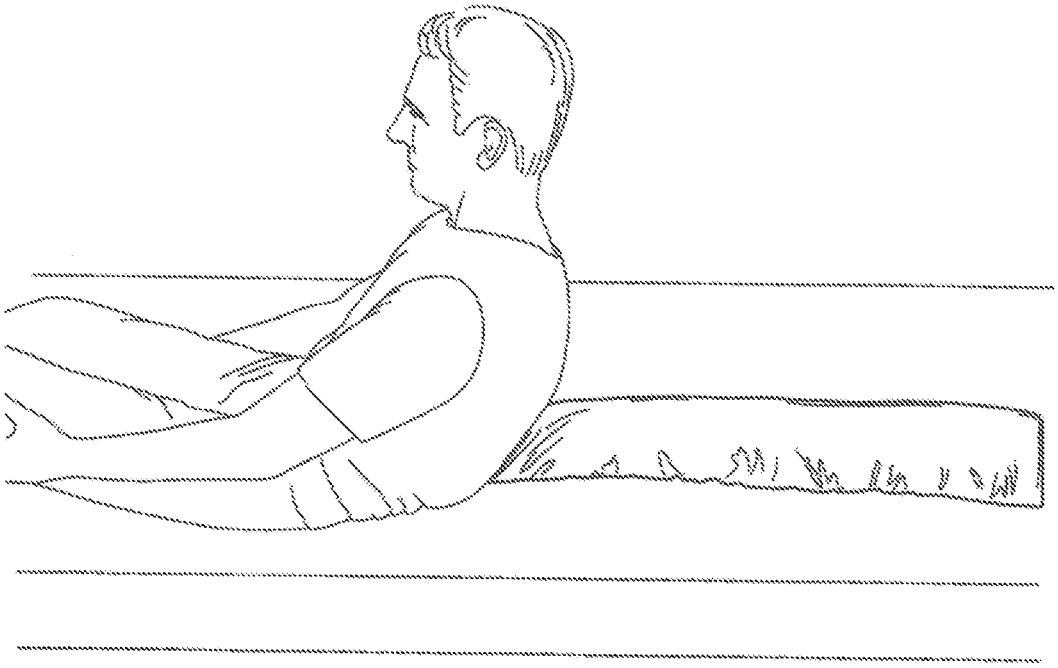
Figure 7A:
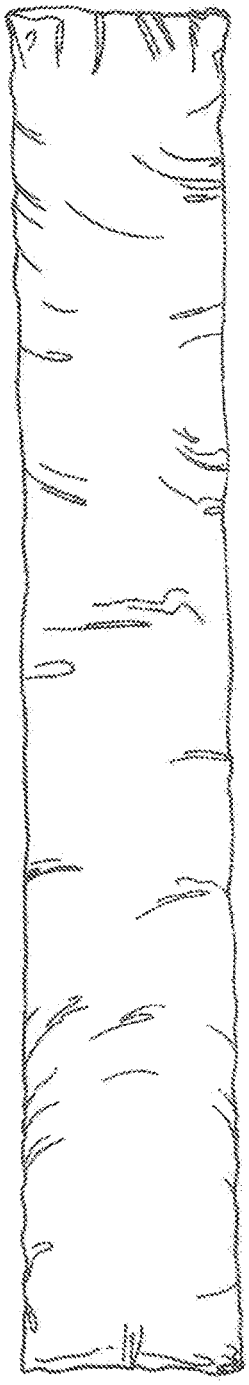
FIGS. 7A and 8A are exemplary top and bottom views of an exemplary embodiment of the pillow.
Figure 8A:
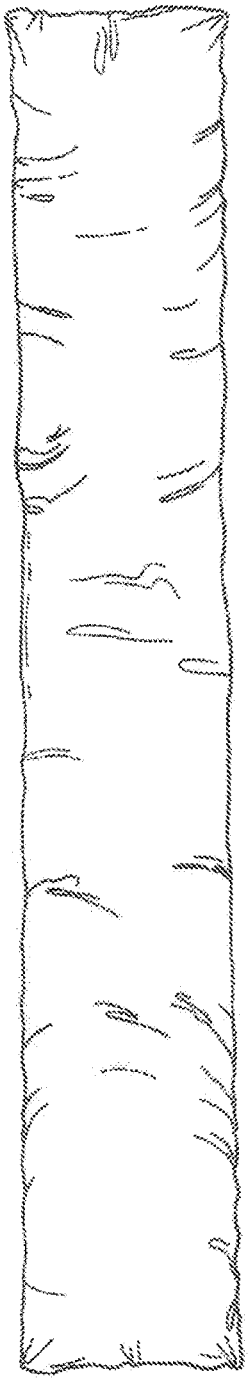
Figure 9:
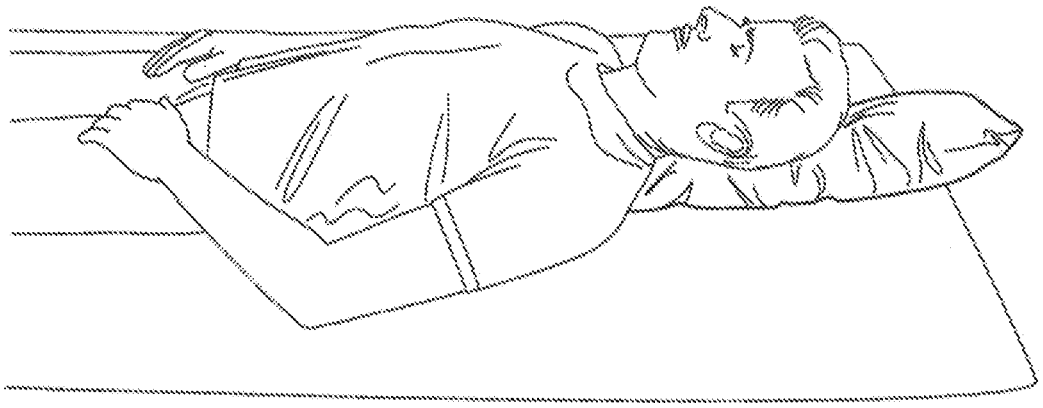
Figure 10:
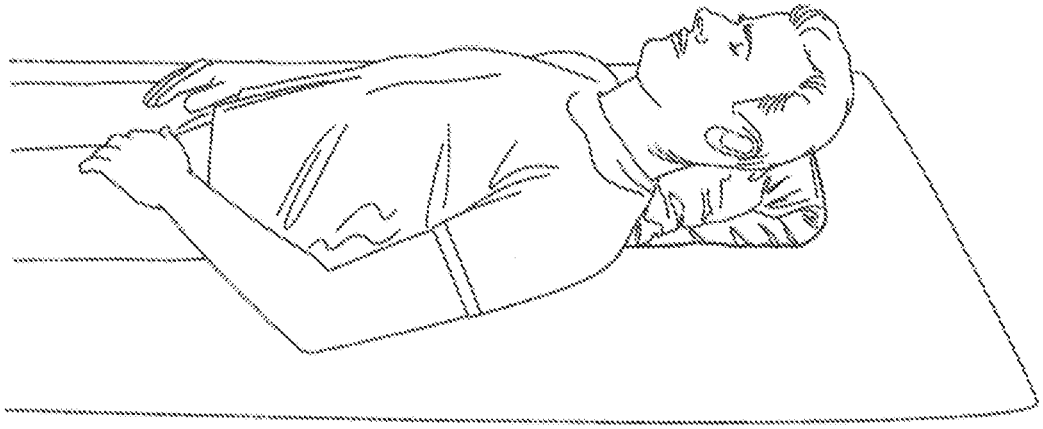
Figure 11:
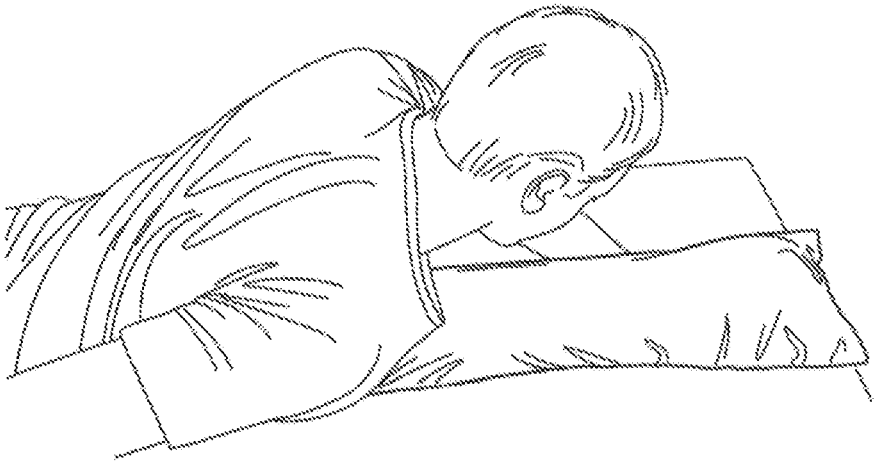
Figure 12:
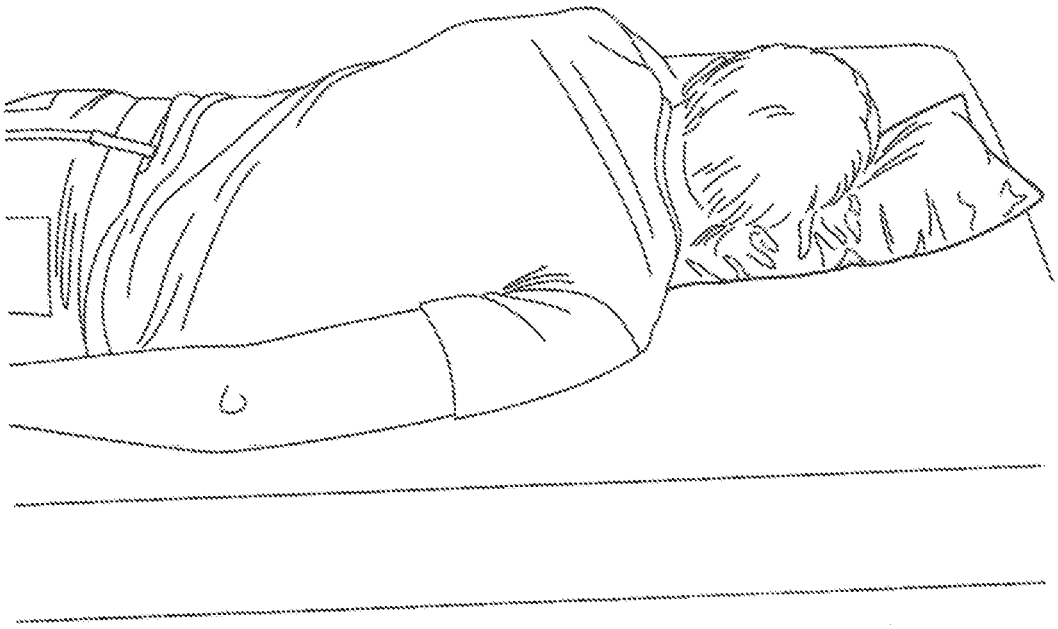
Figure 13:
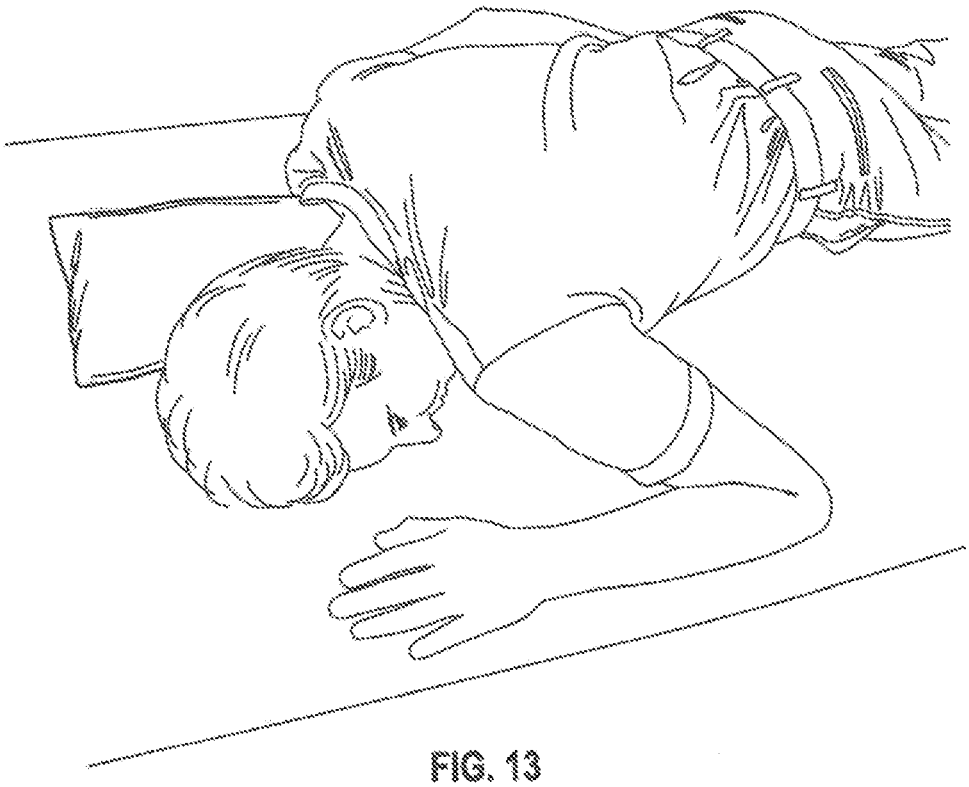
Figure 14:
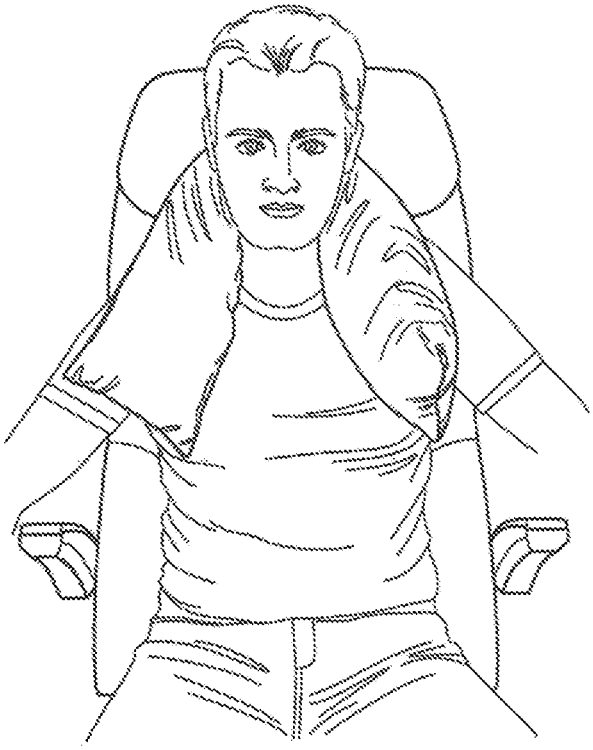
Figure 15:
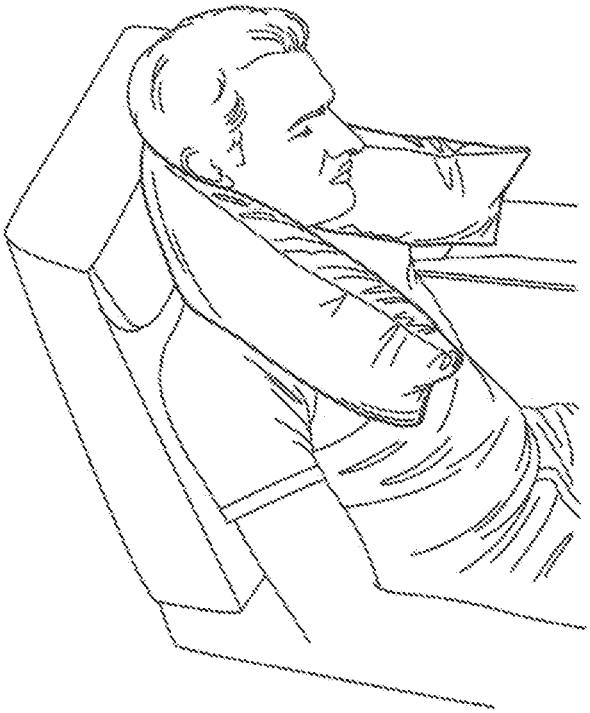
Figure 16:
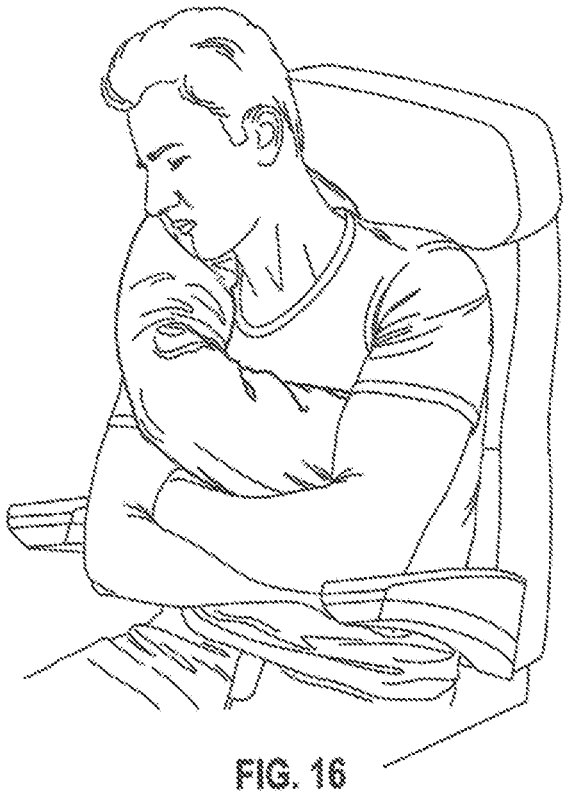
Figure 17:
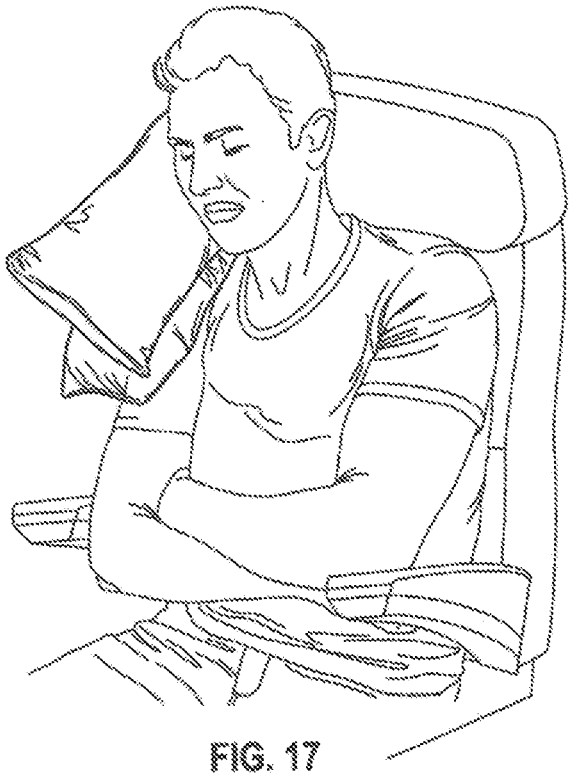
Figure 18:
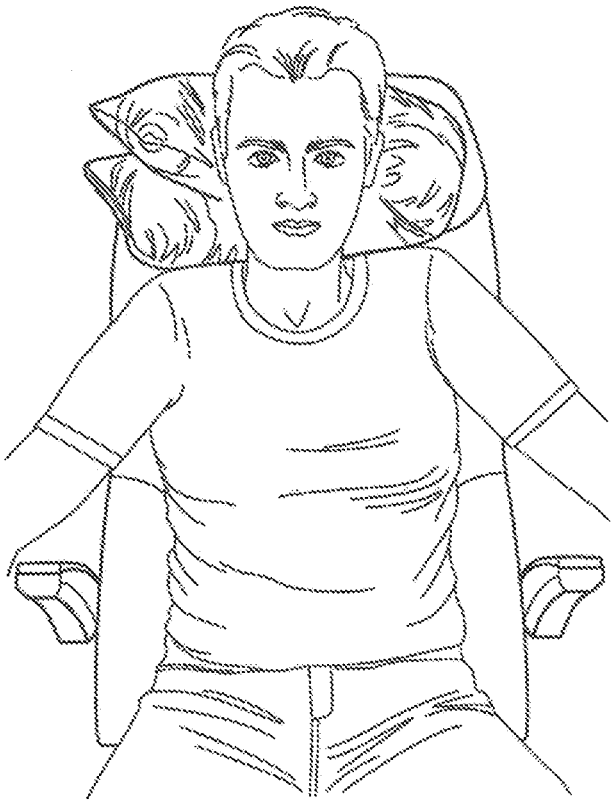
Figure 19:
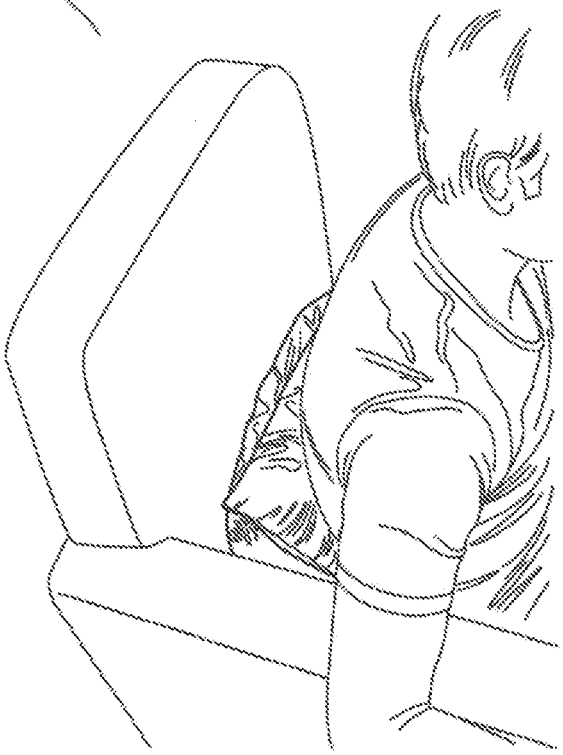

Support pillow 100 or cushion is configured such that it does not limit the user to specific positions. When lying down, pillow 100 is intended to only slightly elevate the head, if at all, and encourages a more natural spine alignment while directing the head away from the shoulders (see FIG. 3). However, should the user desire a slightly more elevated head position, this too may be obtained by doubling over pillow 100, as depicted in FIG. 4. Because of the cylinder design, pillow 100 can be manipulated by the user into many positions while maintaining spine alignment, or it can be manipulated to mimic the resting, sleeping, sitting or lying positions offered by traditional sleep aids including but not limited to therapeutic pillows and other sleep devices (see FIGS. 5, 6, 7,8, 9, 10, 11, 12, and 13). Pillow 100 may also be used in conjunction with conventional therapeutic pillows and sleep devices, or pillow 100 may be used to fully replace any and/or all of them. For many people who prefer to sleep on their stomach, pillow 100 can be used as a wedge between the body and the sleep surface allowing the head to be less contorted during rest (see e.g., FIGS. 11-13). The ultimate goal is to place the head neck and body in the most ergonomically correct position while working with the user's preferred sleep patterns and positions. Also, due to the design and construction, pillow 100 is light and compact enough to be packed away while traveling (see FIGS. 21-25) or can be used while seated as a travel pillow (see e.g., FIGS. 14-19), often not an option with traditional sleep aids. Also, referring to FIGS. 8, 9, and 10 the pillow is depicted under the spine and the head to stretch out the spine and use the body's weight and gravity, providing a feeling not available using an ordinary pillow.

Referring now to FIGS. 3A, 4A, 5A, and 6A, pillow 100 may be constructed with two rectangular shaped textiles 140 and 150 which have elasticity, this elasticity can be horizontal, vertical or both. The two pieces will connect together on all sides either by stitching, hidden zipper, hook and loop or any desired closure (FIG. 2). The purpose of one or more temporary closures is to allow access to the interior of pillow 100, under normal use the access should go undetected by the user during use (FIG. 2). Access to the finished bladder allows the user to add or subtract filler to achieve the desired feel and comfort. The closure or zipper 130 may be hidden in the seam or otherwise so as not to be detected or to interfere with the user's comfort. Referring now to FIG. 9A, in accordance with an exemplary embodiment, within the interior of the cylindrical shape, there may be one or more partitions 160, placed across the diameter of the cylinder and partially attached with some of the partition's perimeter unattached. Partition 160 is configured to limit the fill from flowing freely throughout pillow 100. Partition 160 therefore does not totally compartmentalize fill material 120 but rather works to hinder fill 120 from making its way freely to one area of the cylinder. Once constructed pillow 100 may be filled with viscoelastic memory foam, latex foam, kapok, natural latex foam, natural foam, down, other natural materials or other desired material or combination of materials preferred by the user (see FIG. 2). In the exemplary embodiment depicted in FIG. 9A, partition 160 may be configured as a triangle shape that is attached at each corner to the outer cover but not along the sides so that there may be some flow of fill from one side of the partition to the other, but generally flow of the fill will be impeded by partition 160. Any number of shapes may be used for example a square, a rectangle, or other polygonal shapes. Partition 160 aids in coagulating the fill so as to prevent it from navigating to the ends of the pillow. Also, when the fill is removed and the remaining fill has room to move about the triangle restricts its movement and maintains a more evenly distributed fill and therefore sleep surface. If a user were to fold the pillow and there was no triangle, all the filler would move away from the center. Because of the triangle baffle 160 and its positioning, the fill remains better distributed to provide a supportive cushioned surface.

Figure 20:
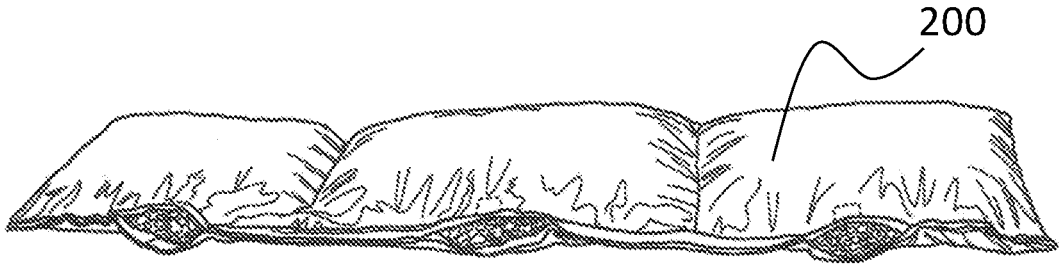
FIG. 20 is another exemplary embodiment of a pillow or cushion.
Figure 21:
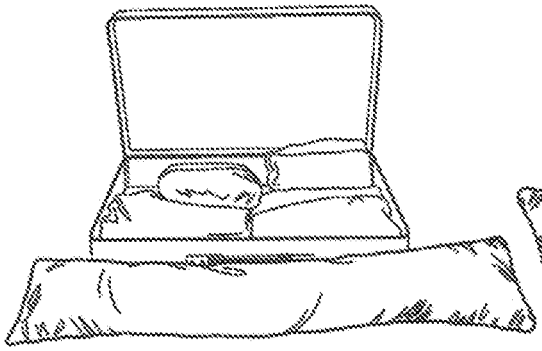
FIGS. 21-25 are exemplary views of an exemplary embodiment of the pillow being packed in a suitcase.
Figure 22:
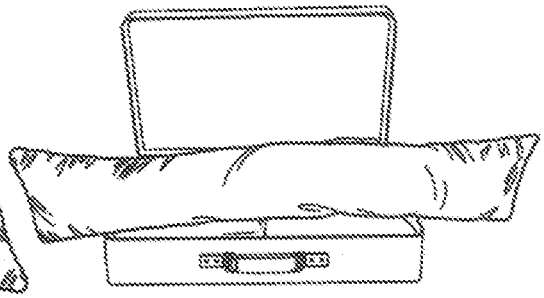
Figure 23:
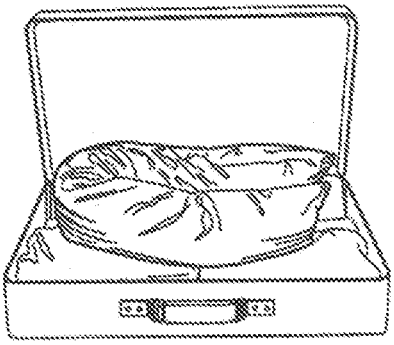
Figure 24:
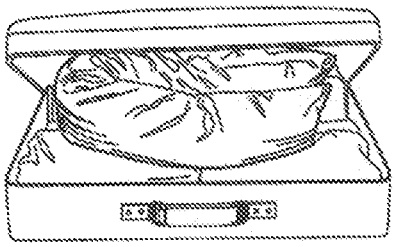
Figure 25:
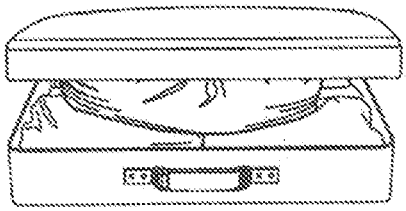

In accordance with another exemplary embodiment as depicted in FIG. 20, a pillow 200 may be configured with independent bladders which have one or more separate compartments closed with stitches, hidden zippers, hook and loop closures or any other type of desired closure. These separate bladders can be used to contain the filler independently and then placed inside the original bladder, offering the user more options of comfort and adjustability as well as easy removal of the tiller for laundering.

In accordance with an exemplary embodiment, the exemplary pillow is a substantially cylindrical shape. When a user is lying on their back, the pillow supports the area of the occipital bone, neck vertebra and top of the shoulders. The pillow supports the neck and head, but if desired will allow the head to rest on the same sleep surface the body is supported by and not solely on the pillow, thereby placing the alignment of the spine in a more ergonomically correct position. The exemplary pillow does not encourage the chin to push toward the chest as is the case with most sleep aids including but not limited to, traditional pillows, cushions, therapeutic pillows, and sleep devices (see FIGS. 1 and 3).

According to exemplary embodiments, the elasticity of the outer cover material allows the pillow to be supple while giving further support to the desired areas with fewer pressure points. Should the user want to turn on their side the pillow works like a track for the neck to rotate on and will again fill the space, this time between the shoulder and the ear (see FIGS. 6 and 7). The body is able to maintain a more natural alignment of the spine as the exemplary pillow works to gently move the head away from the body and allows the head the freedom to lay on the same surface as the overall body. The unique design of the exemplary pillow allows it to be manipulated into many shapes further allowing the user to support their head and body in a number of positions (see, e.g., FIGS. 3-19). Many people prefer to sleep on their stomach which can put unnecessary stress on the neck and back. The exemplary pillow can be used as a parallel wedge between sleep surface and the body by being placed off to one side or directly underneath which tilts or raises the body offering the neck a resting place while decreasing contortion placed on the overall spine. (see, e.g., FIGS. 11-13)

Some of the versatility and advantages of exemplary embodiments of the pillow are as follows:

- Exemplary embodiments discourage elevation of the head (FIGS. 3, 5, 6, and 7). The modern day traditional pillow is an evolution of a design which purposefully elevated the head in order to keep insects out of the hair and the ears of the user, this is no longer a main concern.
- Exemplary embodiments work to avoid elevating the head but can be used to do so when desired (FIGS. 4, 9, 10, 11, and 12). The undesired effect of an elevated head during sleep is that it causes the spine to compress and often distorts the natural "V" in the neck which works like a spring between head and shoulders, holding up the head when we are standing erect. This straightening of the "V" is known as "reversed cervical curve."
- Exemplary embodiments offer access to the bladder(s) which allows the user to control their preferences by adding or subtracting the fill (see, e.g. FIG. 2). When the fill becomes compromised or sleep patterns change the user can add, subtract or replace fill as wants and needs change.
- Exemplary embodiments are small and compact enough to be mobile when traveling (see, e.g., FIGS. 21-25). Traditional sleep aids including but not limited to, traditional pillows, cushions and therapeutic pillows are often confined to being used at home and offer no assistance when user is away from home.
- Exemplary embodiments partially compartmentalize the desired fill with the use of one or more partitions, which work to impede the fill from converging at one area or end. This can be a problem when using other sleeping cushions or pillows where the volume may not fill or occupy the entire area.
- Exemplary embodiments discourage pushing the chin towards the chest (see, e.g., FIGS. 3, 5, 6, and 7). Traditional sleep aids push the chin toward the chest which is an undesired consequence of elevating the head.
- Exemplary embodiments offer multiple uses, positions and/or sleep positions (see e.g., FIGS. 3-19). Other therapeutic pillows offer relatively few sleep positions while still maintaining their desired purpose.
- Exemplary embodiments allow the user to sleep on their stomach or other desired position (see, e.g., FIGS. 11-13). It is not necessary that exemplary embodiments be used just under the head. The exemplary pillow can be used as a wedge or tool to manipulate the body towards the most ergonomically correct position with users who have unique resting positions.
- Exemplary embodiments are not a molded shape, rather the exemplary pillow is configured to confine the fill and the fill is adjusted when manipulating the unique shape of the overall pillow. (See, e.g., FIGS. 1, 2, and 3A-8A). With traditional sleep aids the user may be forced to manipulate a small volume of fill within a comparatively large space. The case with many therapeutic pillows is that there is a molded design shape and the user places his body within the mold design shape.

Many other variations of these embodiments may also exist. For example, the shape of the main bladder could be altered including but not limited to the general length and width while still achieving similar results with regard to the positioning and support of the head neck and body and overall purposefulness of the exemplary pillow. The filler could be exchanged for a number of desired materials. The textile could be substituted with a number of other materials. which expand in different ways or not at all. The overall diameter and/or length could be adjusted to fit different body sizes and types. Closures could be added or subtracted to allow more or less access to the bladder. The elasticity of the textile could be constructed to have a number of different combinations. All closures including but not limited to stitches, zipper, hook and loop could be exchanged for one another or substituted for another type of closer. The overall shape of the exemplary pillow could be changed by altering dimensions of the components including but not limited to substituting two rectangular shapes with two parallelograms. The exemplary pillow could be tapered in many ways, for example forming a bowtie shape (See, FIG. 8A (1)). Essential and nonessential components could be added and/or subtracted. The partition/s could be of various numbers, shapes or sizes, either solid piece or webbed and could be secured in a number of different ways.

In some instances, one or more components may be referred to herein as "configured to," "configured by," "configurable to," "operable/operative to," "adapted/adaptable," "able to," "conformably/conformed to," etc. Those skilled in the art will recognize that such terms (e.g. "configured to") generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A pillow, comprising:

an elongate outer fabric cover at least partially forming a closed elongate tube with the elongate outer fabric cover;

at least one aperture in the closed elongate tube, the at least one aperture having a selective closure associated therewith;

at least one baffle formed within the closed elongate tube, the at least one baffle being formed of fabric and being coupled to the elongate outer fabric cover at at least three points around an interior of the closed elongate tube; and a filling material disposed within the closed elongate tube, the filling material comprising individual pieces of filling material, the filling material configured with a size that it may bypass the at least one baffle, but not generally freely, wherein the elongate outer fabric cover and the filling material are configured to be bendable to any of a variety of shapes; and wherein the at least one baffle comprises a polygon disposed within the closed elongate tube, attached at each corner of the polygon to the elongate outer fabric cover, but not attached along each side of the polygon.

2. The pillow of claim 1, wherein the elongate outer fabric cover comprises an elasticized fabric.

3. The pillow of claim 1, wherein the elongate outer fabric cover comprises an elasticized fabric and the elasticized fabric is configured to stretch in substantially one direction.

4. The pillow of claim 1, wherein the elongate outer fabric cover comprises an elasticized fabric and the elasticized fabric is configured to stretch in substantially two directions.

5. The pillow of claim 1, wherein the selective closure comprises a zipper.

6. The pillow of claim 1, wherein the selective closure comprises a hook and loop closure.

7. The pillow of claim 1, wherein the selective closure comprises a series of snaps or buttons.

8. The pillow of claim 1, wherein the at least one baffle comprises a triangle disposed within the closed elongate tube, attached at each corner of the triangle to the elongate outer fabric cover.

9. The pillow of claim 1, wherein the filling material comprises pieces of foam material.

10. A pillow, comprising:

an elongate outer fabric cover at least partially forming a closed elongate tube with the elongate outer fabric cover, the closed elongate tube being tapered near a middle portion of the closed elongate tube such that the middle portion of the closed elongate tube is substantially narrower than at each end of the closed elongate tube;

at least one aperture in the closed elongate tube, the at least one aperture having a selective closure associated therewith;

at least one baffle formed within the closed elongate tube, the at least one baffle being formed of fabric and being coupled to the elongate outer fabric cover at at least three points around an interior of the closed elongate tube, at least one of the at least one baffle being coupled to the elongate outer fabric cover proximate a middle of the middle portion of the closed elongate tube; and a filling material disposed within the closed elongate tube, the filling material comprising individual pieces of filling material, the filling material configured with a size that it may bypass the at least one baffle, but not generally freely, wherein the elongate outer fabric cover and the filling material are configured to be bendable to any of a variety of shapes; and wherein the at least one baffle is substantially perpendicular to the closed elongate tube.

11. The pillow of claim 10, wherein the elongate outer fabric cover comprises an elasticized fabric.

12. The pillow of claim 10, wherein the elongate outer fabric cover comprises an elasticized fabric and the elasticized fabric is configured to stretch in substantially one direction.

13. The pillow of claim 10, wherein the elongate outer fabric cover comprises an elasticized fabric and the elasticized fabric is configured to stretch in substantially two directions.

14. The pillow of claim 10, wherein the selective closure comprises a zipper.

15. The pillow of claim 10, wherein the selective closure comprises a hook and loop closure.

16. The pillow of claim 10, wherein the at least one baffle comprises a triangle disposed within the closed elongate tube, attached at each corner of the triangle to the elongate outer fabric cover.

17. The pillow of claim 10, wherein the at least one baffle comprises a polygon disposed within the closed elongate tube, attached at each corner of the polygon to the elongate outer fabric cover.

18. The pillow of claim 10, wherein the filling material comprises pieces of foam material.

19. The pillow of claim 10, wherein the closed elongate tube has a cylindrical shape, and the at least one baffle is formed along a diameter of the cylindrical shape.

20. A pillow, comprising:

an elongate outer elasticized fabric cover at least partially forming a closed elongate tube with the elongate outer elasticized fabric cover, the closed elongate tube being tapered near a middle portion of the closed elongate tube such that the middle portion of the closed elongate tube is substantially narrower than at each end of the closed elongate tube;

at least one aperture in the closed elongate tube, the at least one aperture having a zippered closure configured to provide selective access to an interior of the closed elongate tube;

at least one baffle formed within the closed elongate tube, the at least one baffle being formed of fabric and being coupled to the elongate outer elasticized fabric cover at three points around the interior of the closed elongate tube, at least one of the at least one baffle being coupled to the elongate outer elasticized fabric cover proximate a middle of the middle portion of the closed elongate tube, the at least one baffle comprising a triangle shaped piece of fabric, disposed within the closed elongate tube, and attached at each corner of the triangle shaped piece of fabric to the elongate outer elasticized fabric cover; and a filling material disposed within the closed elongate tube, the filling material comprising individual pieces of filling material, the filling material configured with a size that it may bypass the at least one baffle, but not generally freely, wherein the elongate outer elasticized fabric cover and the filling material are configured to be bendable to any of a variety of shapes.

* * * * *